US007578004B2

(12) United States Patent
Loyens et al.

(10) Patent No.: US 7,578,004 B2
(45) Date of Patent: Aug. 25, 2009

(54) PROTECTIVE SLEEVE AND METHOD OF PROTECTION

(75) Inventors: Rolf Loyens, Nepean (CA); Ross Angus, Gloucester (CA)

(73) Assignee: Pro_Formance Insights R.A. Inc., Gloucester (CA)

( * ) Notice: Subject to any disclaimer, the term of this patent is extended or adjusted under 35 U.S.C. 154(b) by 0 days.

(21) Appl. No.: 11/578,568

(22) PCT Filed: Apr. 15, 2005

(86) PCT No.: PCT/CA2005/000575

§ 371 (c)(1),
(2), (4) Date: Oct. 16, 2006

(87) PCT Pub. No.: WO2005/099499

PCT Pub. Date: Oct. 27, 2005

(65) Prior Publication Data

US 2007/0204373 A1 Sep. 6, 2007

Related U.S. Application Data

(60) Provisional application No. 60/562,313, filed on Apr. 15, 2004.

(51) Int. Cl.
*A41D 13/08* (2006.01)

(52) U.S. Cl. ..... 2/16; 2/59

(58) Field of Classification Search ..... 2/16, 2/22, 161.1, 162, 170, 59
See application file for complete search history.

(56) References Cited

U.S. PATENT DOCUMENTS

| | | | | |
|---|---|---|---|---|
| 1,217,307 | A * | 2/1917 | Heise | 2/162 |
| 2,715,226 | A | 8/1955 | Weiner | |
| 3,000,378 | A * | 9/1961 | Zieman | 602/62 |
| 4,738,893 | A | 4/1988 | Grillo | |
| 4,864,656 | A | 9/1989 | Nesse | |
| 4,989,266 | A | 2/1991 | Borgese et al. | |
| 5,044,011 | A | 9/1991 | Henderson | |
| 5,623,728 | A * | 4/1997 | Wagner | 2/462 |
| 5,734,992 | A | 4/1998 | Ross | |
| 6,038,701 | A | 3/2000 | Regan | |
| 6,044,498 | A | 4/2000 | Schumann et al. | |
| 6,141,800 | A | 11/2000 | Regan | |
| 6,155,084 | A | 12/2000 | Andrews et al. | |
| 6,845,522 | B2 * | 1/2005 | Beland | 2/462 |
| 2004/0123373 | A1 * | 7/2004 | Yamada | 2/161.2 |
| 2006/0162043 | A1 | 7/2006 | Angus | |

FOREIGN PATENT DOCUMENTS

| | | |
|---|---|---|
| CA | 1229511 | 11/1987 |
| EP | 0 765 612 | 2/1997 |
| WO | 00/08410 | 2/2000 |

* cited by examiner

*Primary Examiner*—Katherine Moran

(57) ABSTRACT

A protective sleeve for protecting a person's arm comprises a forearm section, an upper arm section and a flexible connection between the forearm section and upper arm section. An elbow section is connected between the forearm and upper arm sections and covers the flexible connection. The sections of the protective sleeve each comprise a plurality of layers of cut resistant material enclosed within an outer covering. In one embodiment, a hand protector is either permanently connected or releasably connectable to the sleeve and comprises one or more layers of high tensile strength fabric.

16 Claims, 12 Drawing Sheets

PROTECTIVE SLEEVE AND METHOD OF PROTECTION

CROSS REFERENCE TO RELATED APPLICATIONS

This is a U.S. National Phase application of International Patent application No. PCT/CA2005/000575 filed on 15 Apr., 2005, which claims priority from U.S. Application No. 60/562,313 filed on 15 Apr., 2004.

FIELD OF THE INVENTION

The present invention relates to protective clothing and in particular to protective sleeves for protecting the arm of a wearer from damage by sharp objects.

BACKGROUND OF THE INVENTION

Protective vests are commonly used by police and military personnel engaged in dangerous activities to protect vital organs within the torso from damage by high velocity projectiles such as bullets, sharp fragments and other ordnance. Protective vests typically comprise a number of layers of high performance, ballistic resistant material such as NYLON™or KEVLAR™ to absorb the energy of the projectile and prevent it penetrating through the vest to the body. So called bulletproof vests are generally sleeveless and are designed specifically to protect the front and back of the torso region.

SUMMARY OF THE INVENTION

According to one aspect of the present invention, there is provided a protective sleeve comprising a forearm section for covering at least a portion of a forearm, an upper arm section for covering at least a portion of an upper arm, a flexible connection between the forearm section and the upper arm section, and an elbow section for covering at least a portion of an elbow.

In one embodiment, the protective sleeve comprises a discrete member, which means that the sleeve is independent of any other item of clothing and may be put on or taken off separately and independently of any other article of clothing. Advantageously, this arrangement provides protection specific to the arm of a wearer and need only be worn as required for a specific purpose or operation. The protective sleeve may form part of an overall protective system and allows the system to be adapted or configured differently depending on its intended use.

In one embodiment, the protective sleeve may comprise means for adjusting the tightness of fit of the sleeve around an arm. This allows the sleeve to be adapted to different sizes of arms and to the number and thickness of layers of clothing already covering the arm. The adjusting means also provides a means of securing the sleeve to the arm and reducing any slippage. The adjusting means may comprise an adjuster on any one or more of the forearm section, the elbow section and the upper arm section, and each may allow separate adjustment of the internal cross sectional area or width of the sleeve to suit an individual wearer.

In embodiments of the present invention, at least one of the forearm section, the elbow section and the upper arm section has opposed separable longitudinal edges for providing a longitudinal opening therebetween. Advantageously, this arrangement provides the sleeve with a side opening along at least a portion of its length to facilitate donning and doffing the sleeve. Once an arm is placed within the sleeve, the sleeve opening may be closed simply by wrapping about the arm and optionally overlapping portions adjacent the longitudinal edge. A retaining means is preferably provided to retain the protective sleeve in the closed position.

In embodiments of the present invention, at least one of the forearm section, the elbow section and the upper arm section may comprise a material which is relatively resistant to cutting by sharp objects, and in particular may comprise one or more layers, (e.g. 1 to 25 for example 8, 9, 10, 11 or 12) of a high performance material/fabric, a ballistic resistant material/fabric, a high tensile strength material/fabric, for example NYLON™, an aramid material such as KEVLAR™, SPECTRA™, TWARON™, DYNEEMA™, another synthetic material or any mixture of these.

In embodiments of the present invention, the protective sleeve may further comprise a glove section connected to the forearm section, for example by means of a flexible connector section. The glove section may include a cuff section and a lower end portion of the forearm section may be received within the cuff section and overlap therewith. The forearm section and glove and/or cuff section may be continuously connected about the circumference thereof in order to prevent objects passing between the forearm section and the cuff or glove section into the interior of the glove.

The glove section and/or cuff section may include one or more layers of protective material. The protective material may be used for one or more digits of the glove, and/or other parts such as the upper part which covers the hand, and the lower part which covers the palm. The protective material may include any one or more materials disclosed herein, as well as others.

In embodiments of the present invention, the elbow section may be connected to the sleeve so that at least one of the forearm section and the upper arm section can slide relative to the elbow section to increase the flexibility of the sleeve about the elbow joint and facilitate articulation between the forearm and upper arm.

In some embodiments, any one or more of the upper arm section, the forearm section and the elbow section are partially independent of one another to allow adjacent sections to move relatively freely relative to one another for enhanced flexibility.

According to another aspect of the present invention, there is provided a protective sleeve comprising a glove section for protecting the hand of a wearer, and a forearm section for covering the forearm of a wearer, wherein the glove section is connected to the forearm section.

According to another aspect of the present invention, there is provided a discrete protective sleeve comprising a high performance material.

Embodiments of the discrete protective sleeve comprise any one or more features disclosed herein.

According to another aspect of the present invention, there is provided a protective sleeve for protecting a person's arm comprising a first web of protective flexible material for covering at least part of a person's arm, the web having opposed first and second longitudinal edges capable of being moved towards and away from each other to vary the circumference of the sleeve, and a second web of flexible material attached to the first web and extending between said first and second opposed longitudinal edges of said first web.

According to another aspect of the present invention, there is provided, a protective sleeve for protecting a person's arm comprising an upper arm section for covering at least a portion of a person's upper arm between the elbow and shoulder, said upper arm section having an upper free end and comprising a web of protective material, and a skirt adjacent the upper end and connected to and around the circumference of the upper arm section and defining an aperture therein for receiving a person's arm.

According to another aspect of the present invention, there is provided a protective sleeve for protecting a person's arm comprising an upper arm section for covering at least a portion of the person's upper arm between the elbow and shoulder region, said upper arm section having an upper free end and comprising a web of protective material, and a retainer positioned in the interior of the upper arm section for securing about a person's upper arm to secure the upper arm section to a person's upper arm.

According to another aspect of the present invention, there is provided a hand protector comprising an upper part and a lower part defining a pocket therebetween for receiving a person's hand, wherein said lower part comprises one or more layers of material, and the lower part has an inner surface facing the interior of the pocket for contacting a person's hand and wherein at least a portion of said inner surface is a high friction surface for resisting relative movement along the surface between the surface and the hand.

According to another aspect of the present invention, there is provided a hand protector comprising an upper part for covering at least a portion of an upper part of a person's hand and a lower part for covering at least a portion of a lower part of a person's hand, said upper and lower parts defining a pocket therebetween for receiving a person's hand, and wherein at least one of the upper part and the lower part comprises a plurality of layers of high tensile strength flexible material.

BRIEF DESCRIPTION OF THE DRAWINGS

Examples of embodiments of the present invention will now be described with reference to the drawings, in which.

DETAILED DESCRIPTION OF EMBODIMENTS

Figures 1A, 1B:
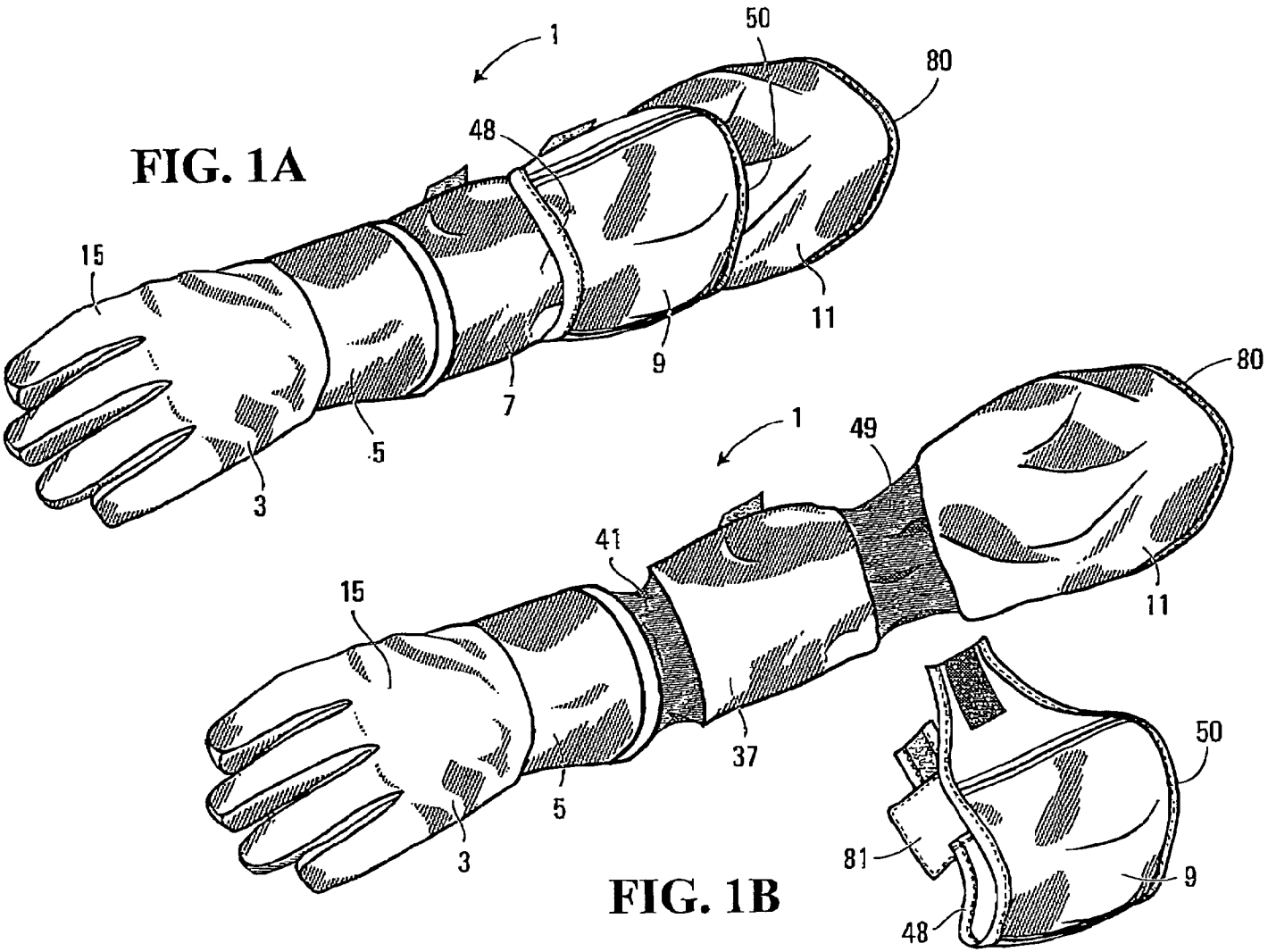
FIG. 1A shows a perspective upper view of a protective sleeve according to an embodiment of the present invention.
FIG. 1B shows a perspective upper view of the protective sleeve shown in FIG. 1A with the forearm section extended from the glove section and the elbow section detached from the sleeve.
Figure 2:
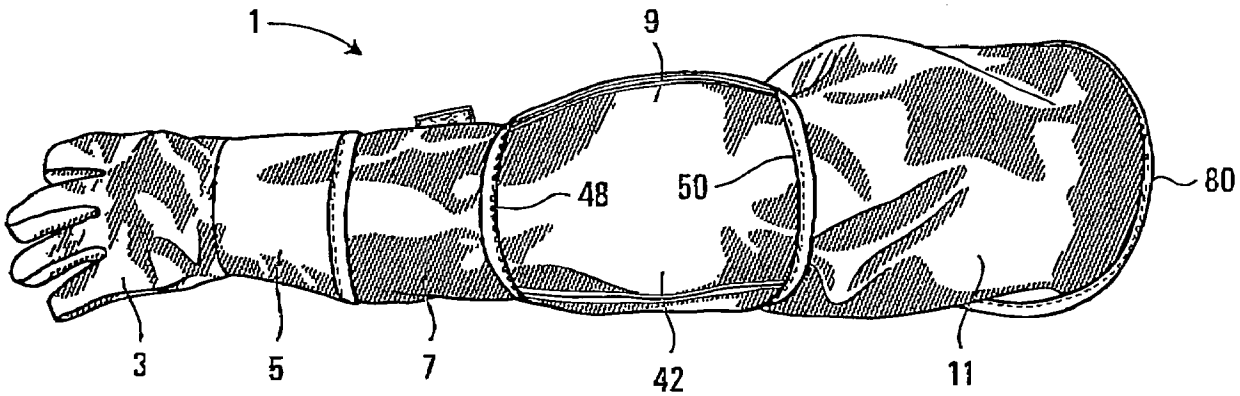
FIG. 2 shows a perspective view of the protective sleeve shown in FIGS. 1A and 1B with the sleeve oriented along the line of the outer elbow.

Referring to FIGS. 1A to 6, a protective sleeve 1 according to an embodiment of the present invention comprises a glove section 3, a cuff section 5, a forearm section 7, an elbow section 9 and an upper arm section 11. The glove section 3 has upper and lower parts 15, 17 for covering the upper part and lower part (or palm) of a hand, respectively, including the fingers and thumb. In this embodiment, the glove includes separate finger and thumb pockets 19, 21, 23, 25, 27, although in other embodiments, the glove may include fewer pockets which are shared by two or more fingers and/or the thumb. The upper part 15 may comprise a protective material such as a high performance, high tensile strength fabric, for example NYLON™, an aramid material such as KEVLAR™, SPECTRA™, TWARON™, DYNEEMA™or other similar materials that are relatively resistant to cutting by sharp objects. The lower part 17 may comprise a protective material having similar properties to that of the upper part, and may optionally include a surface structure or other treatment which provides a relatively high friction surface 29 to assist in gripping and holding objects. In one embodiment, the structure may comprise an array of discrete areas or pads of rubber-type or other high-friction-type material. The high friction surface may be provided by an outer layer of material, for example, C-TACK™, or other material. The interior surface of the glove may be of a high friction-type to reduce slippage between a person's hand and the glove, for example in the palm and/or finger and/or thumb regions. The lower part of the glove 17 preferably includes protective material in the region 31 of the base of the palm so that this area, which exposed when the fist is clenched, is also protected. In a preferred embodiment, the glove includes protective material in all exposed areas of the glove when the fist is clenched, including the fingers and palm.

The cuff section 5 of the protective sleeve 1 is connected to the glove section 3 and extends rearwardly from the end 33 of the glove section for surrounding and protecting a wearer's wrist and lower forearm. The cuff section may comprise a protective material which is relatively cut-resistant, such as a high performance fabric, and may be similar to the protective material used for the glove, as exemplified above.

The forearm section 7 comprises one or more layers of protective material for surrounding and protecting the forearm region of a wearer's arm. The lower peripheral end portion (or band) 37 of the forearm section 7 is received within the cuff section 5 so that at least a portion of the cuff section overlaps the forearm section to provide additional protection. The forearm section 37 may be connected to the cuff section or glove section by any suitable means. In a preferred embodiment, the forearm section is connected to the cuff or glove section by an intermediate section 41 of material which has a higher degree of flexibility than at least one of the cuff section and the forearm section. The material may be flexible in a direction out of the plane of the material, and in one embodiment, may be flexible within the plane of the material, i.e. stretchable or elasticated. In one embodiment, the intermediate connecting section 41 may comprise SPANDEX™ or other similar material. FIG. 1B shows a semi-exploded view of the sleeve with the forearm section 7 pulled out from the cuff section 5 with the intermediate connecting section 41 connected therebetween. Although, in embodiments of the present invention, it may be possible to pull the forearm section out of the cuff section, in other embodiments, the cuff and forearm section may be connected so that it is not possible to pull the forearm section from the cuff to expose the connecting section 41. The connecting section may form a continuous connection between the cuff (or glove) and the forearm section in order to prevent objects entering the interior of the glove. Advantageously, the use of a flexible connecting section provides flexibility between the glove and forearm sections to preserve freedom of movement in the wrist, and may allow the glove to rotate relative to the forearm section in any one or more degrees of freedom, including rotation about the longitudinal axis of the arm.

Figure 5:
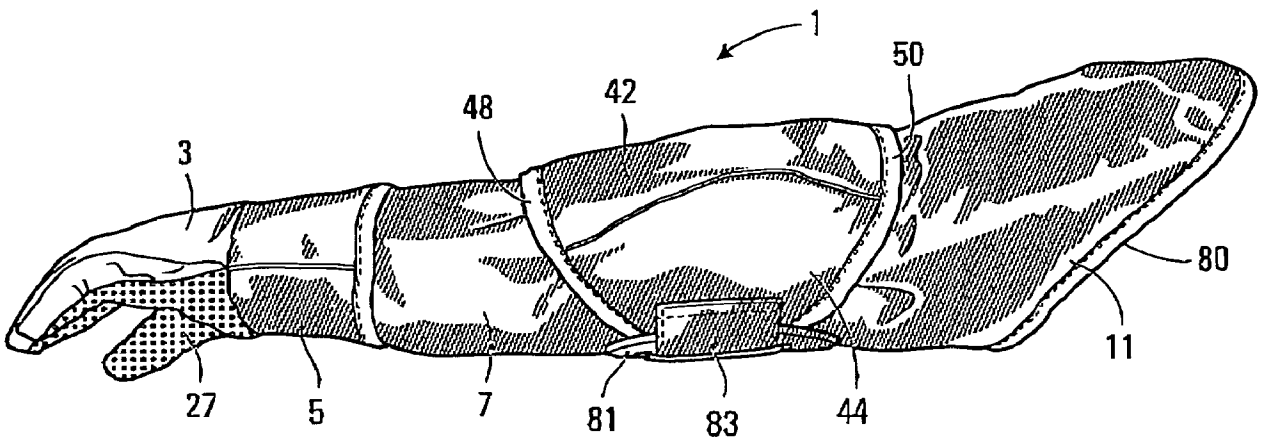
FIG. 5 shows a bottom view of the protective sleeve shown in FIGS. 1 to 4.

As shown in FIG. 1B, the forearm section 7 is connected to the upper arm section 11 by means of a connection section 49. The connection section is preferably formed of a flexible material and may have a higher degree of flexibility than either one or both of the forearm and upper arm sections. The material may be flexible in a direction out of the plane of the material and, in addition, may also be flexible within the plane of the material, i.e. stretchable or elasticated, and in one embodiment may comprise a mesh material and/or an elastic material such as SPANDEX™ or other similar or equivalent material. A mesh type material provides enhanced breathability for air circulation and cooling. The connection section 49 is positioned in the elbow region between the forearm and the upper arm sections and enhances flexibility of the sleeve in the elbow region. The upper arm section 11 extends from the elbow region to the upper arm near the deltoid, although in other embodiments the upper arm section may extend to a higher or lower level. As shown in FIG. 5, the length of the outside of the upper arm section is longer than the inside to protect the low deltoid and at the same time allows the sleeve to extend to the armpit. In this embodiment, the upper arm section is tapered outwardly from the elbow to the upper arm, to generally conform to the shape of an arm. The upper arm section preferably comprises protective material such as a cut-resistant fabric, and may comprise the same or similar material to that described above in connection with the glove, cuff and forearm sections. The protective material may extend around a part of, or the entire circumference of the upper arm section.

A means for securing the upper arm section about a person's upper arm may be provided. The securing means may be positioned at a location at or near the tip of the bicep. The securing means may comprise a stretchable ring through which a person's arm passes and which tightly fits around a person's upper arm, e.g. at a position near the top of the bicep. An example of such an embodiment is described below with reference to FIGS. 7 to 15.

The elbow section 9 is positioned between the forearm and upper arm sections 7, 11 and covers the intermediate connection section 49. The elbow section may comprise one or more layers of protective material such as a cut-resistant fabric (e.g. an aramid or other synthetic material) as described above in connection with the glove, cuff, forearm and upper arm sections.

The elbow section 9 may be connected to the protective sleeve in a manner which preserves flexibility between the forearm and upper arm sections. In one embodiment, the elbow section may be connected to the sleeve at a region near the inside of the elbow, with the outer portion of the elbow section extending over adjacent end portions of the forearm and/or upper arm sections but not connected thereto (or only connected loosely) so that the forearm and/or upper arm sections can slide with respect to the elbow section. Advantageously, the overlap between the elbow section and the adjacent ends of the forearm and upper arm sections provide continuous protection and at the same time the floating relationship between the outer elbow section and the forearm and upper arm sections provide a high degree of flexibility of the sleeve in the elbow region to facilitate full articulation between the forearm and upper arm about the elbow joint.

As shown in FIGS. 2 to 6, the elbow section has an outer elbow portion 42 and inner elbow portions 44, 46, where side edges of the elbow section 48, 50 taper inwardly from the outer to the inner portions. This reduces the amount of material on the inside of the elbow to reduce "bunching" of material to improve flexibility and comfort.

Figure 6:
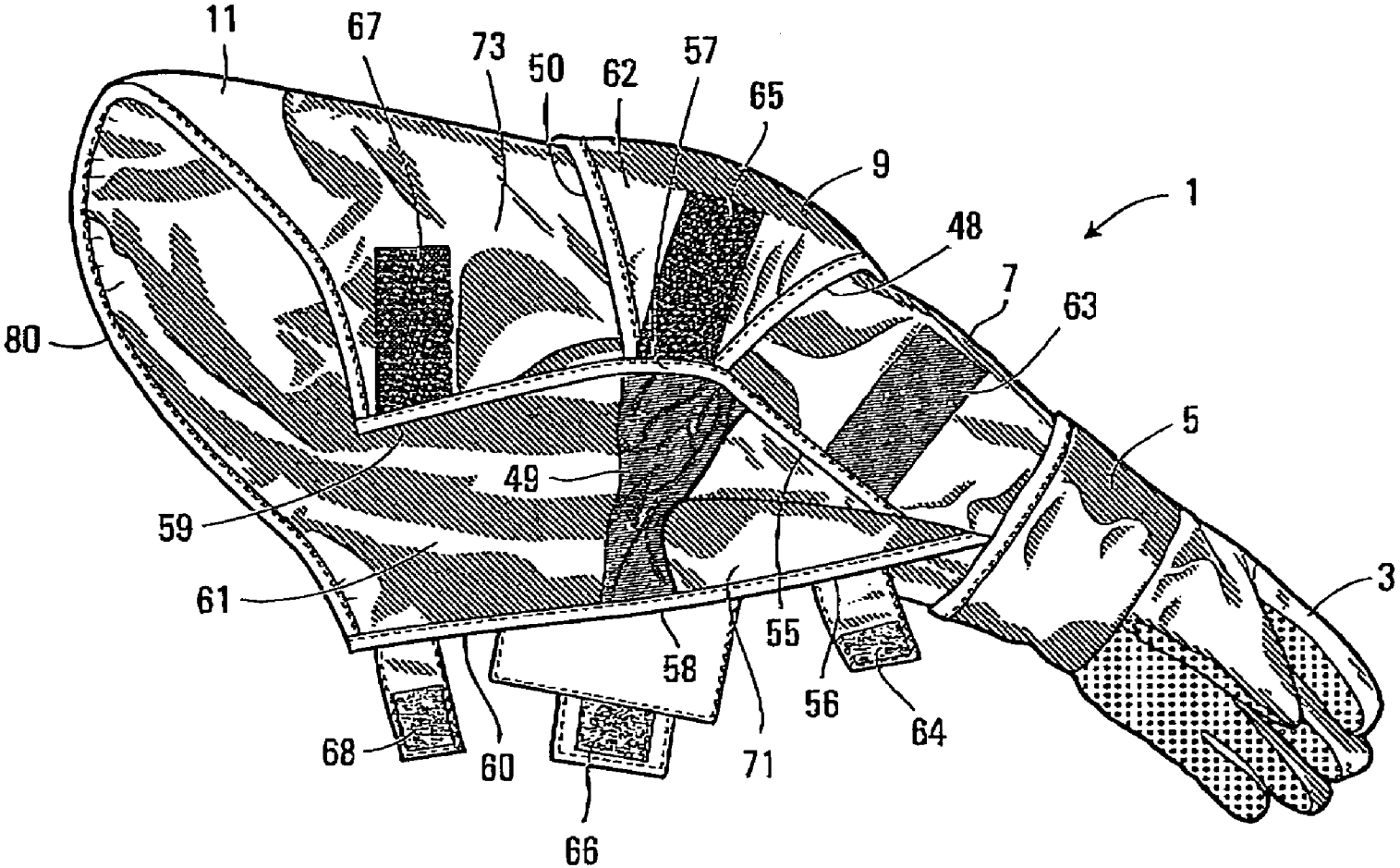
FIG. 6 shows a perspective view of the protective sleeve of FIGS. 1 to 5 with sections of the sleeve in the open position for receiving a person's arm.
Figure 7:
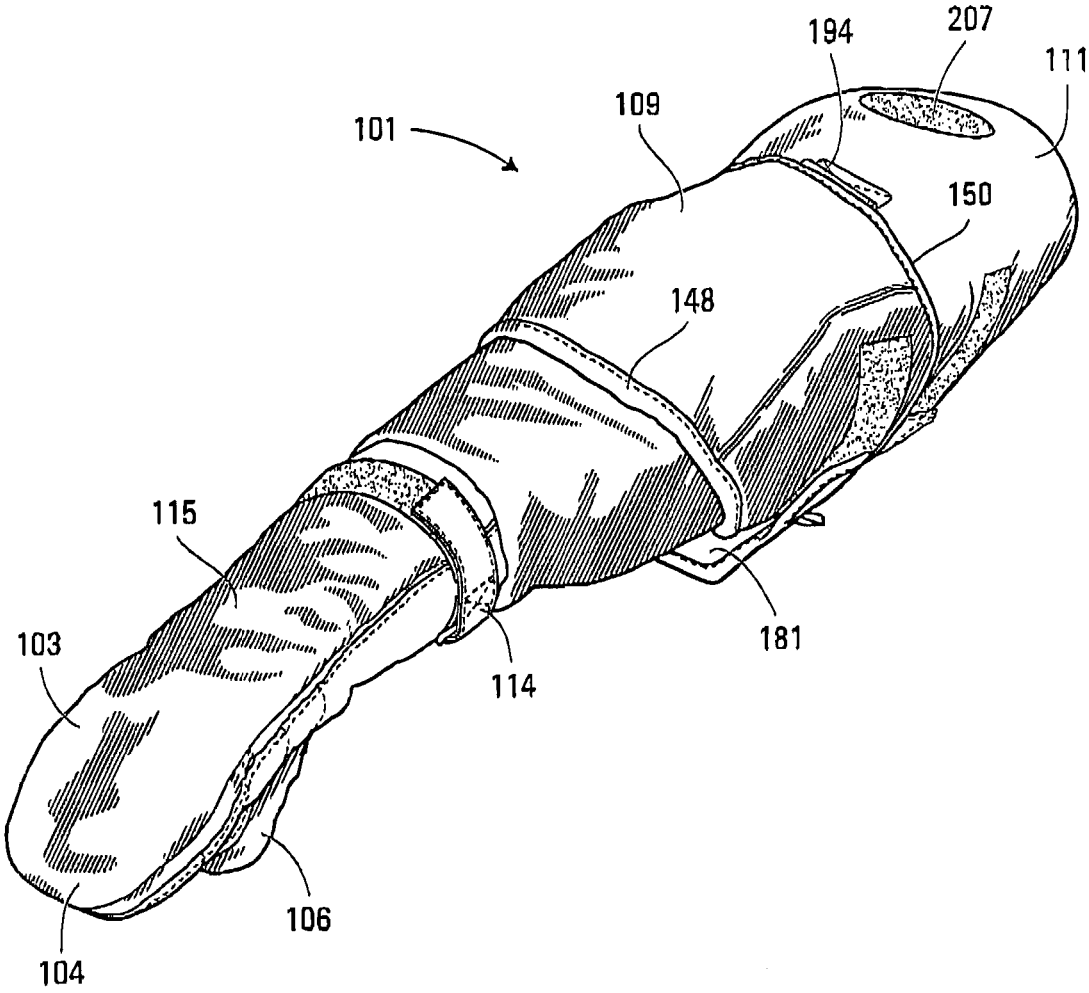
FIG. 7 shows a perspective upper view of a protective sleeve according to another embodiment of the present invention.
Figure 8:
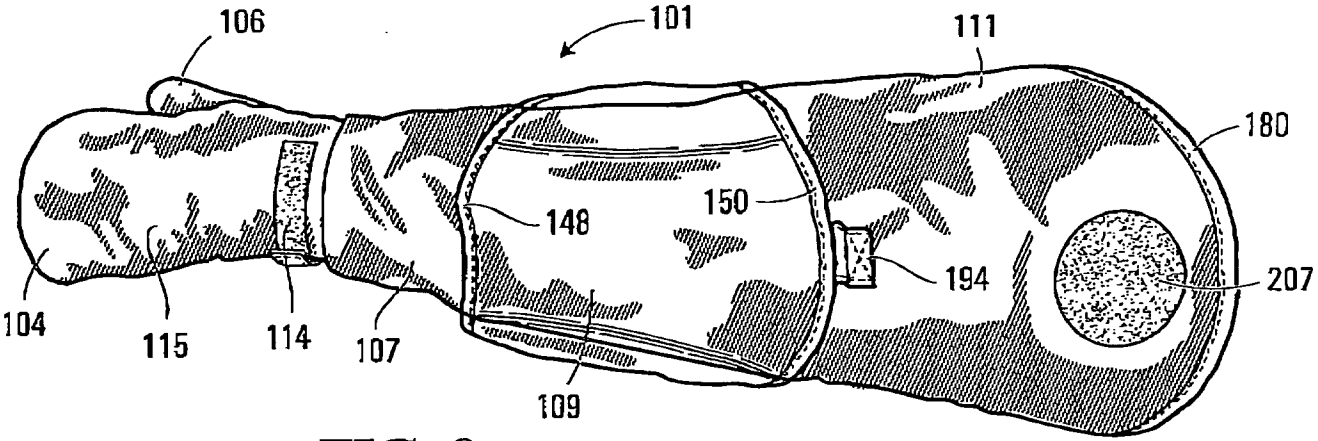
FIG. 8 shows a view of the protective sleeve shown in FIG. 7 with the sleeve oriented along the line of the outer elbow.

As shown in FIG. 6, the forearm section, the elbow section and the upper arm section can all be opened along their respective lengths to facilitate donning and doffing the protective sleeve. Each of the forearm section, elbow section and upper arm section have respective opposed longitudinal edges 55, 56, 57, 58, 59, 60 which define an opening 61 for receiving an arm, and which may overlap one another when the sleeve is closed so that it fully surrounds the arm. One or more fasteners may be provided to fasten one side of the sleeve to the other, and in this embodiment, a fastener 63, 65, 67 is provided on each of the forearm, elbow and upper arm sections. Any suitable fasteners may be used, and in one embodiment, the fasteners may comprise interactive fastening strips such as hook and loop type fasteners (e.g. VELCRO ™) or similar fasteners or their equivalents, or snap fasteners, buttons as well as others.

In any embodiment of the protective sleeve, a web of flexible material may be provided across the opening 61, which, while allowing the width of sleeve to expand to facilitate donning and doffing, provides a barrier to prevent objects such as glass shards or other objects passing into the interior of sleeve between the longitudinal edges.

The web may be positioned at any suitable location for example in any one or more of the forearm, elbow and upper arm sections. The web may be attached to each side of the sleeve, for example at positions near the longitudinal edges.

In this embodiment, the elbow section 9 is connected to the intermediate connecting section 49 and optionally to the forearm and/or upper arm sections along its opposed longitudinal edges 57, 58. Alternatively, the elbow section may be attached to any one or more of the forearm section, the connection section and the upper arm section. Preferably the elbow section is connected to one or more of these other sections at a position near the inner elbow, e.g. at or near the opposed longitudinal edges 57, 58. The elbow section may be connected only along its edge, or may also be connected to portions of the sleeve in regions inwardly of the edge. However, preferably, the outer portion 62 of the elbow is not connected (or only loosely connected) to at least one of the forearm and upper arm sections for increased flexibility and freedom of movement.

Figure 3:
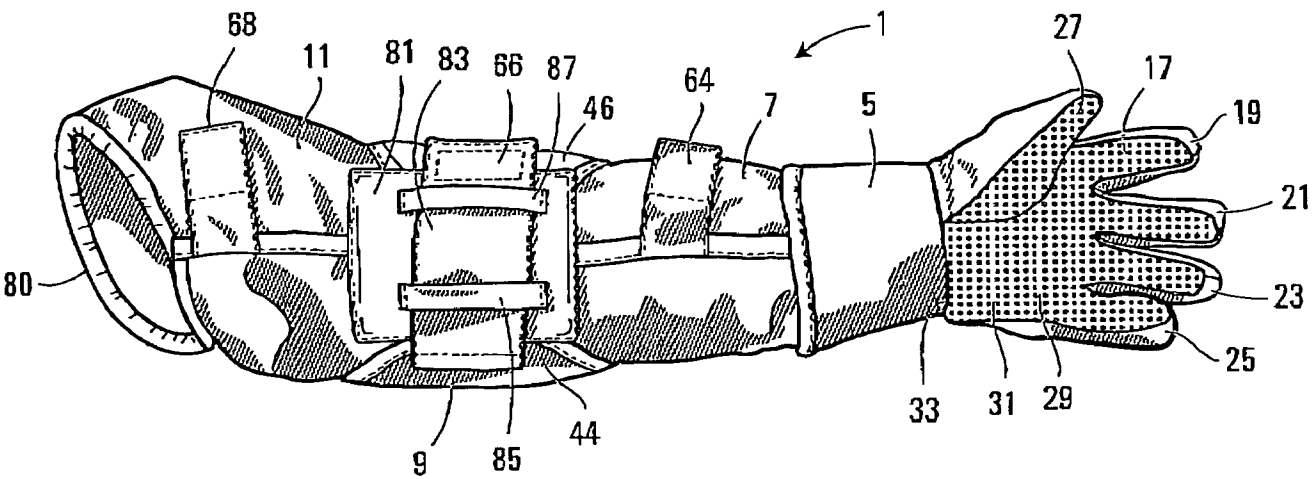
FIG. 3 shows a perspective view of the protective sleeve shown in FIG. 2 with the sleeve oriented along the line of the inner elbow.
Figure 4:
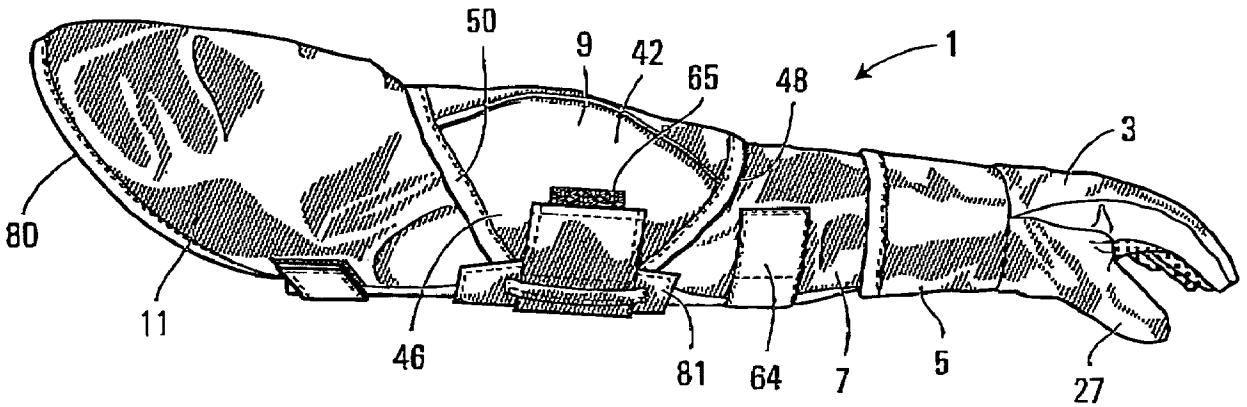
FIG. 4 shows a view of the top of the protective sleeve shown in FIGS. 1 to 3.

Referring in particular to FIGS. 3 to 5, the elbow section may optionally include a cover 81 positioned in the region of the inner elbow for additional protection. The cover overlaps the area of closure between opposed longitudinal edges of the elbow section so as to reduce the potential of objects, for example, glass penetrating the elbow fissure. The cover may be connected to the sleeve on one side of the elbow section and may be closed over the junction of the elbow section and fastened to the other side of the elbow section by means of a fastener. Although in one embodiment, the fastener may be connected to the cover 81, in the embodiment shown in FIGS. 2 to 4, the elbow section further includes a tab 83 which extends from one side 44 of the elbow section over the cover 81 through one or more retaining straps 85, 87 provided on the cover, and a fastener 66 is carried on the other end of the tab 83 for fastening with a complementary fastener 65 (shown in FIGS. 4 and 6). The complementary pair of fastening members may comprise VELCRO™ or other interactive surface fasteners, or any other type of fastener. In this embodiment, the cover 81 extends part way along the inside of the upper arm section 11 and part way along the inside of the lower arm or forearm section 7. The cover 81 may comprise any material and may comprise a protective material, including any material disclosed herein. The tab 83 may also be made of any protective material and in embodiment comprises a heavy denier Nylon™ type material. In other embodiments, the cover 81 may have any other configuration or shape and may be fastened to the elbow section by any other technique.

In the embodiment shown in FIG. 6, the lower portion 71 of the sleeve overlaps the upper portion 73, and the lower portion 71 carries fastening tabs 64, 66, 68. In this arrangement, the fasteners are released by pulling the tabs in a downward motion which is more natural and easier to execute than an upward motion. Advantageously, the same motion also causes the sleeve to open for quick removal of the sleeve. Alternatively, one or more fastening tabs may be provided on the upper portion 73, so that the fasteners are released by pulling upwardly.

As the sleeve is discontinuous about its circumference, the circumference of the sleeve may be adjusted to suit arms having different circumferences so that the sleeve is fully adjustable to individual wearers, and its tightness may be adjusted as required. The use of interactive strip fasteners also allows continuous adjustment of the circumference of the sleeve when closed, and, in the embodiment of FIG. 6, individual fasteners on each of the forearm, elbow and upper arm sections allows individual adjustment of the sleeve tightness in each of these three regions.

In embodiments of the present invention, each of the glove section, cuff section, forearm section, elbow section and upper arm section is formed of a flexible material so that each section has some degree of flexibility. The connecting sections between the glove and forearm section and between the forearm section and upper arm section may comprise a different material to that used in the other sections of the protective sleeve, or may comprise the same material. To increase the flexibility of the connecting sections, these sections may be formed from fewer layers of material than are used for the other sections of the sleeve.

Although the embodiment shown in FIG. 6 has a longitudinal opening to facilitate putting the sleeve on and taking it off, in other embodiments, the longitudinal opening may be omitted. In other embodiments, the sleeve may have a circumference which is substantially larger than a wearer's arm, possibly with an enlarged upper opening to facilitate putting it on and taking it off, and a portion of the sleeve may be folded longitudinally to tighten the sleeve against a wearer's arm, and fastened, as required.

FIGS. 7 to 13 show a protective sleeve according to another embodiment of the present invention. Referring to FIGS. 7 to 13, the protective sleeve 101 comprises a hand protector 103, a forearm section 107, an elbow section 109 and an upper arm section 111. In this embodiment, the hand protector 103 is in the form of a mitt comprising a single pocket 106 for receiving all four fingers and a separate pocket 106 for receiving a thumb. The hand protector comprises upper and lower parts 115, 117 for covering the upper part and lower part (palm) of a person's hand, respectively. The upper part 115 may comprise one or more layers of protective material such as a high tensile strength material (e.g. an aramid material or other synthetic material) to protect the hand from cutting by sharp objects. Similarly, the lower part 117 of the hand protector may comprise one or more layers of protective material as indicated above. The outer layer of the lower part may alternatively, or in addition to a protective material (e.g. high tensile strength fabric), comprise a flexible material having water repellent and/or high surface friction characteristics, and in one embodiment may comprise a plastic or rubberized material such as C-TACK™. A high friction surface makes it easier to grasp objects. At least part of the interior space of the mitt (e.g. the palm and/or finger region) may have high friction characteristics to reduce slippage between the hand and mitt.

In this embodiment, the hand protector is permanently connected to the lower part of the forearm section and may be connected thereto by any suitable means such as stitching or gluing or may be integrally formed with the forearm section. In other embodiments, the hand protector may be releasably fastenable to the forearm section as described below in conjunction with FIGS. 14 and 15.

In the present embodiment, an optional adjuster 114 is provided on the mitt in the wrist or cuff region to allow this region of the mitt to be adjustably tightened around a person's wrist.

The forearm, elbow and upper arm sections are similar in some respects to those of the embodiment described above and shown in FIGS. 1 to 6. One or more, and preferably each of these sections 107, 109, 111 preferably comprises one or more layers of protective material such as a high tensile strength flexible material which is relatively resistant to cutting by sharp objects. For example, the protective material may comprise an aramid or other synthetic material, such as NYLON™.

Figure 12A:
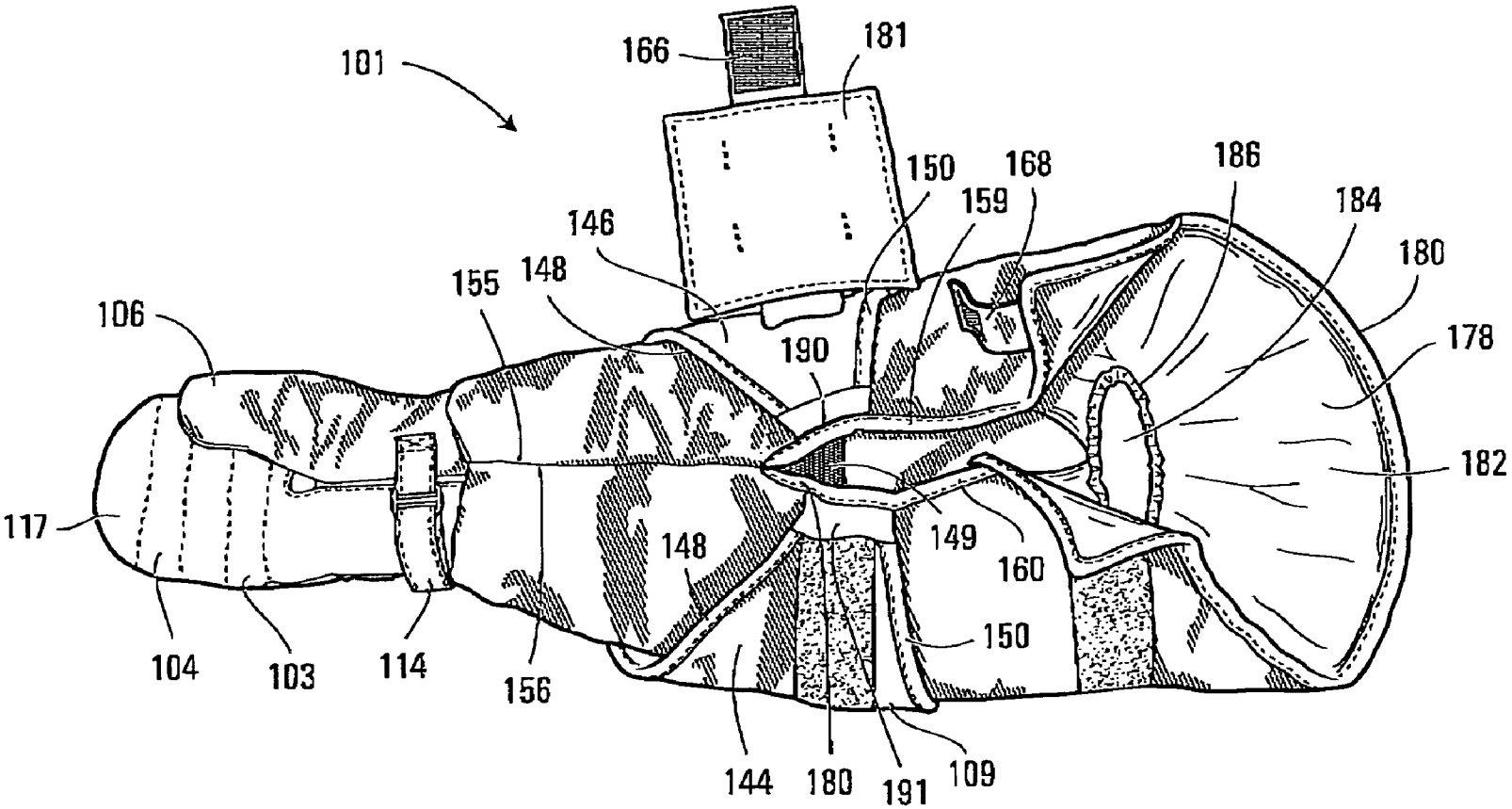
FIGS. 12A and 12B show a view of the protective sleeve shown in FIGS. 7 to 11, with the sleeve oriented along the line of the inner elbow and with the protective flap and upper arm section in the open position.
Figure 12B:
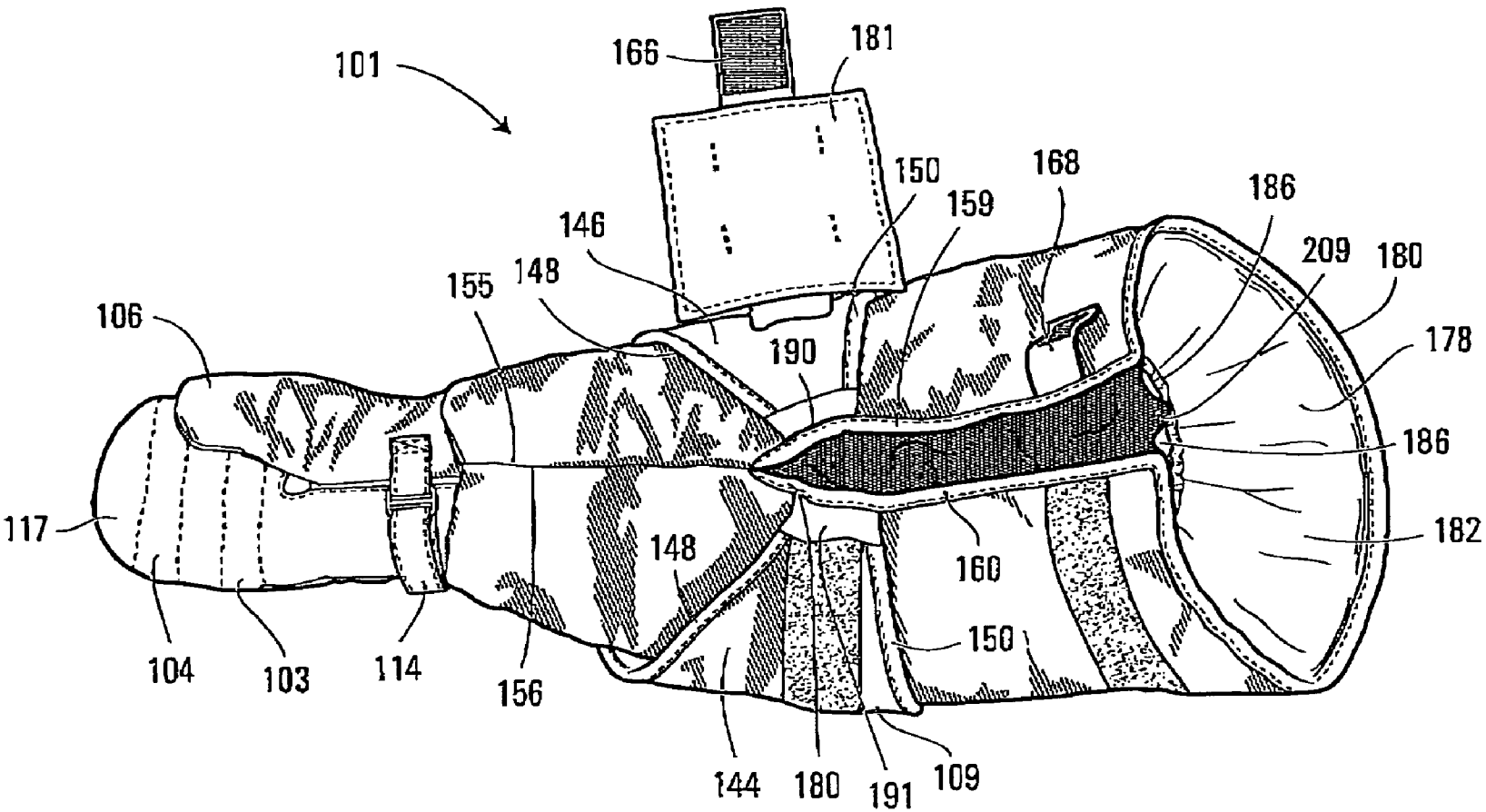
Figure 13:
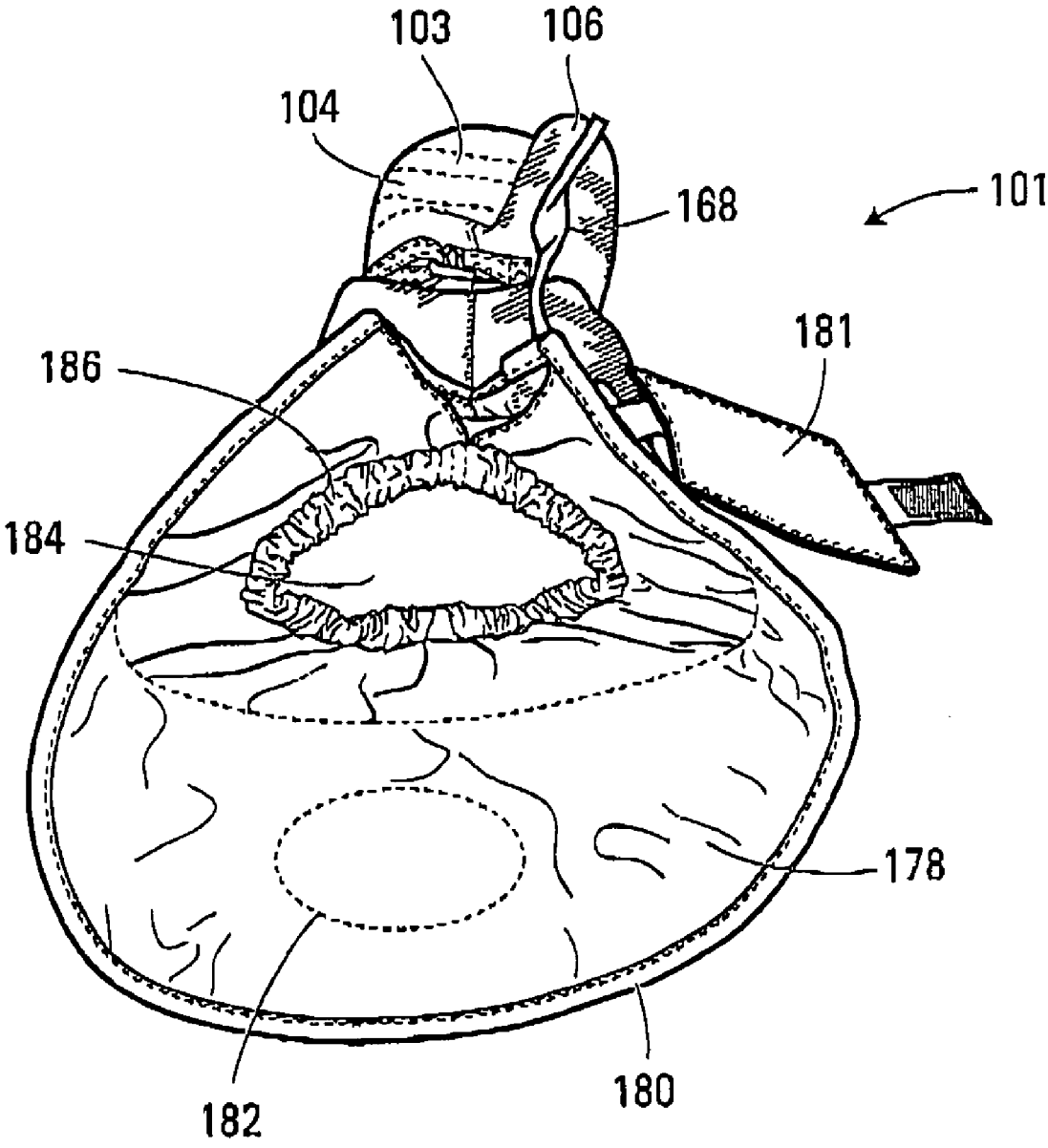
FIG. 13 shows a view of the protective sleeve shown in FIGS. 7 to 12 from the upper arm end along its longitudinal length.

As shown in FIGS. 12A and 12B, the upper section of the protective sleeve has opposed free longitudinal edges 159, 160 to allow the upper arm section to be opened along the inside, and in this embodiment, the edges extend to the inside elbow region 180. These longitudinal free edges allow the upper portion of the sleeve to be opened to facilitate donning and doffing and can be overlapped to assist in adjusting the width of the sleeve to an individual wearer and tightening the upper part of the sleeve against the wearer's arm.

In this embodiment, the forearm section 107 forms a circumferentially continuous cover for covering a person's forearm, as for example shown in FIGS. 12A and 12B. In this embodiment, the opposed longitudinal edges 155, 156 are connected together so that they cannot open, in contrast to the embodiment shown in FIG. 6. This arrangement of the forearm section does not have any longitudinal gaps through which objects could pass into the interior of the protective sleeve.

As best shown in FIGS. 10, 12A, 12B and 13, a protective barrier or curtain 178 is provided adjacent the free end 180 of the upper arm section both to assist in preventing objects from passing from the free end and into the interior of the sleeve between the sleeve and the wearer's arm, and also for assisting in securing the upper arm section to a person's arm.

In this embodiment, the protective barrier or curtain 178 comprises a web of material in the form of an annular ring whose outer circumference is secured to and about the end 180 of the upper arm section 111, and has an aperture 184 for receiving a person's arm. The circumferential edge 185 of the aperture may be formed so that the circumference of the aperture can be varied to accommodate different size arms. In one embodiment, the circumferential edge 185 is elasticized to conform automatically to the shape of a person's arm and to hold the circumferential edge firmly against a person's arm.

The protective barrier 178 may comprise any suitable material such as a flexible fabric, and may comprise a protective flexible fabric such as an aramid or other synthetic material.

Figure 9:
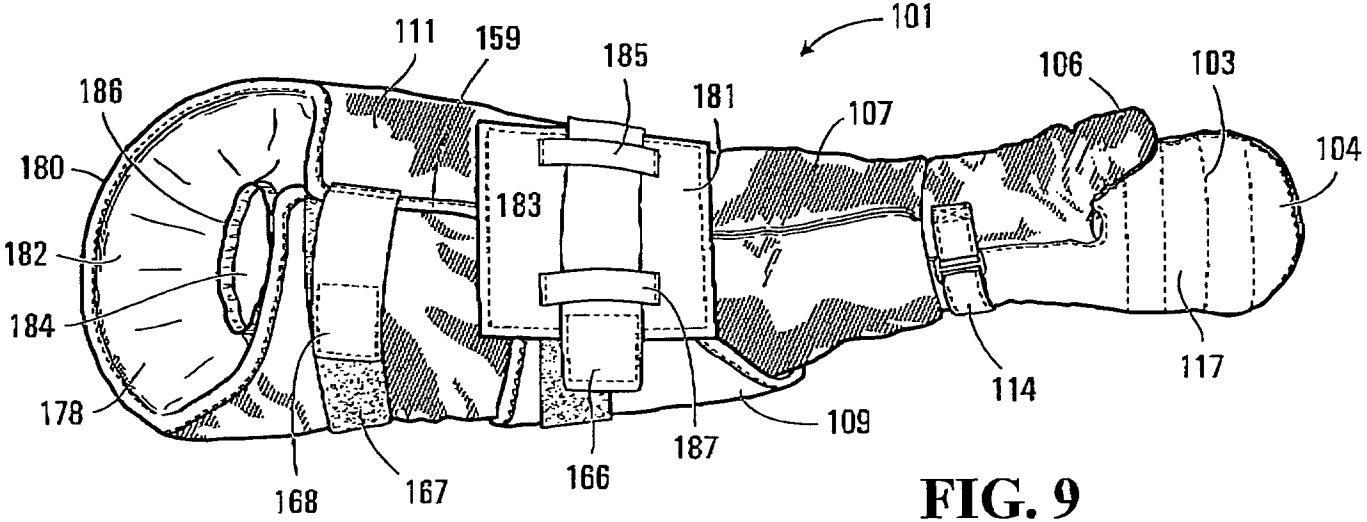
FIG. 9 shows a view of the protective sleeve shown in FIG. 8 with the sleeve oriented along the line of the inner elbow.
Figure 10:
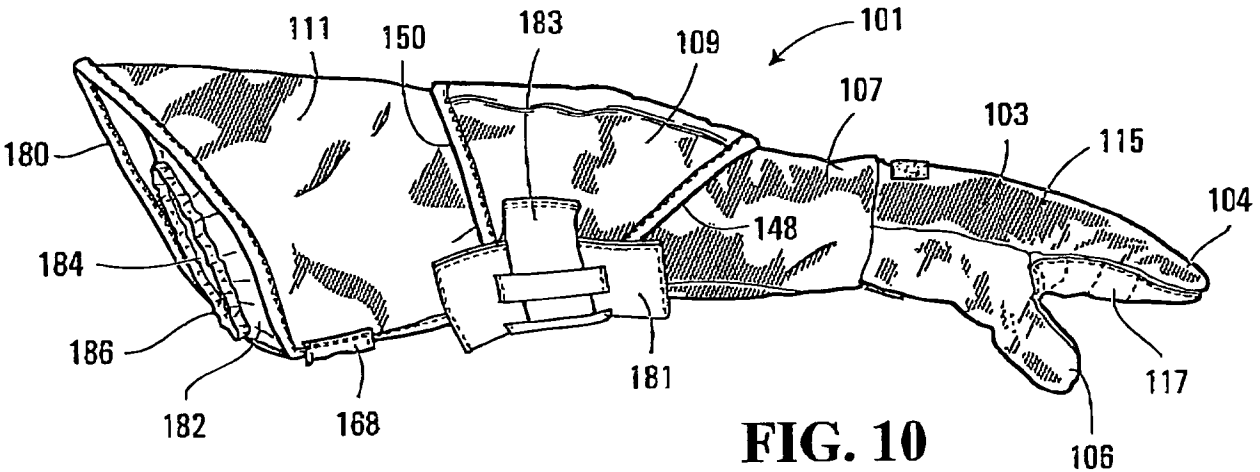
FIG. 10 shows a view of the top of the protective sleeve shown in FIGS. 7 to 9.
Figure 11:
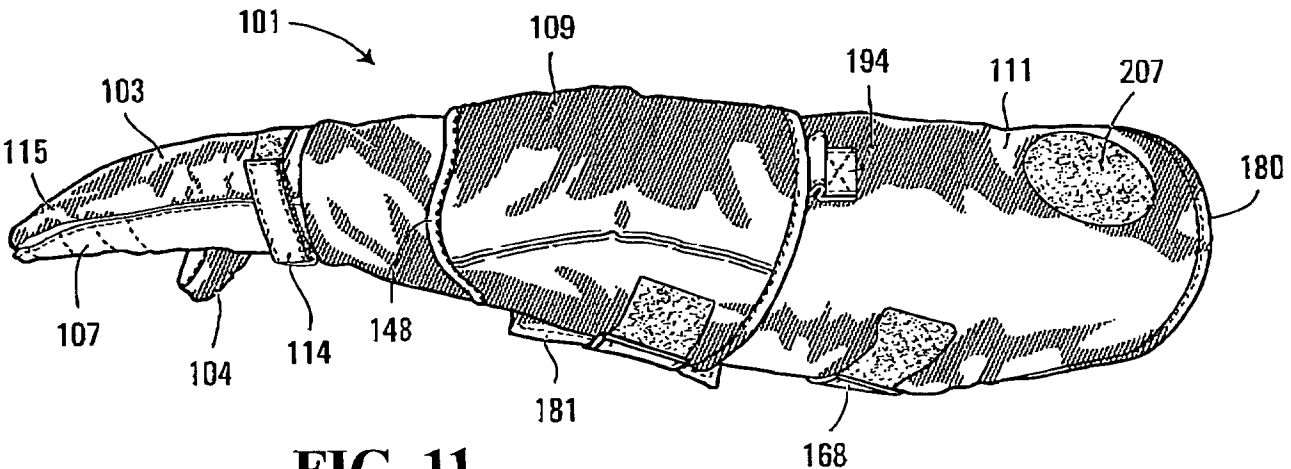
FIG. 11 shows a bottom view of the protective sleeve shown in FIGS. 7 to 10.

As for the embodiment shown in FIGS. 1 to 6, the protective sleeve includes a protective cover 181 for covering the inside elbow region. In this embodiment, the protective cover 181 overlaps a portion of the elbow section 109 and, optionally, part(s) of the forearm and/or upper arm sections as shown in FIG. 9. The construction of the cover may be similar to that described above in connection with FIG. 1.

In this embodiment, the protective cover 181 is attached to the upper portion 146 of the elbow section 109 and includes a fastener 166 for releasably fastening the protective cover 181 to the lower portion of the elbow section 144. Thus, in contrast to the embodiment of FIGS. 1 to 6, in the embodiments of FIGS. 7 to 13, the protective cover is permanently attached to the upper portion of the elbow section and released from the lower portion thereof.

The forearm and upper arm sections are connected together in a similar manner to the embodiment of FIGS. 1 to 6, and in particular are connected together by means of an intermediate flexible section 149, shown in FIG. 12A. The flexible section may comprise any suitable material, such as a mesh material and may be stretchable.

The elbow section 109 is connected to the protective sleeve in a similar manner to that described above in connection with the embodiment of FIGS. 1 to 6. In particular, the elbow section 109 has opposed ends 190, 191 which are attached to the sleeve in the inside elbow region, as shown in FIG. 12. However, the opposed edges 148, 150 of the elbow section are not attached to the forearm and upper arm sections, respectively so that the forearm and upper arm sections can slide relative to the elbow section to facilitate articulation, flexing and movement of the forearm relative to the upper arm about the elbow joint. However, one or more connecting members 194 may be provided to loosely connect the elbow section to the upper arm and/or lower arm sections of the protective sleeve to more securely couple the elbow section to one or more other sections of the sleeve and to limit movement thereof to some extent.

Referring to FIG. 12B, a web of flexible material 209 is connected along the opposed longitudinal free edges 159, 160 of the sleeve to prevent objects passing through the gap between the free ends 159, 160 into the interior of the sleeve. The flexible material may comprise any suitable material, including a mesh material.

Any one or more of the features of the embodiment shown in FIGS. 7 to 12, may be added to or substituted in the embodiment of FIGS. 1 to 6 and vice versa.

Figure 14:
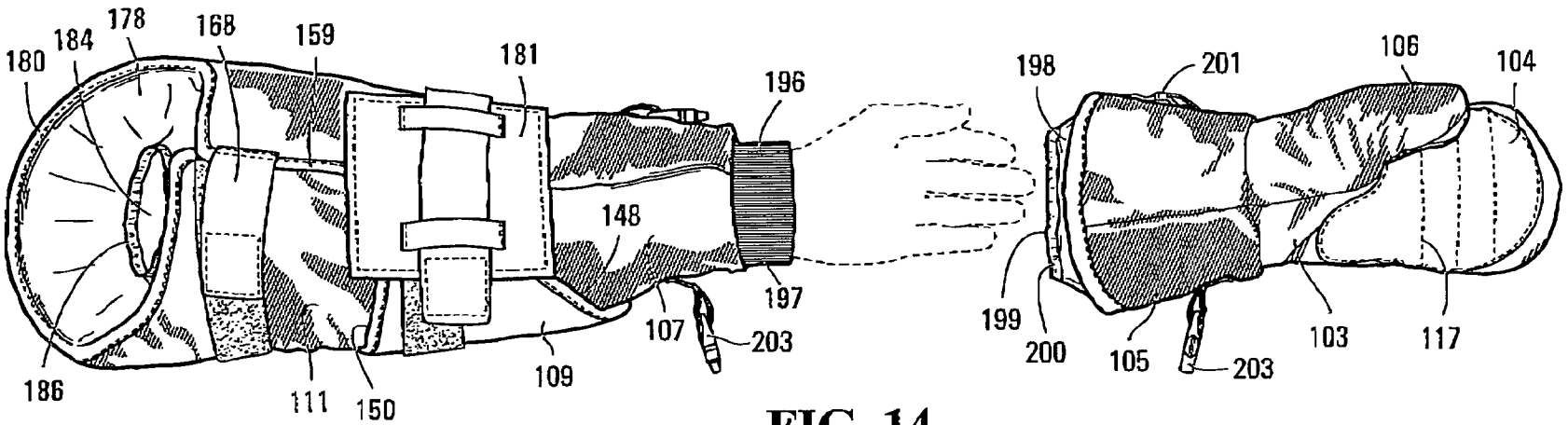
FIG. 14 shows a view of another embodiment of a protective sleeve with the sleeve oriented along the line of the inner elbow and with a detachable mitt or glove.
Figure 16:
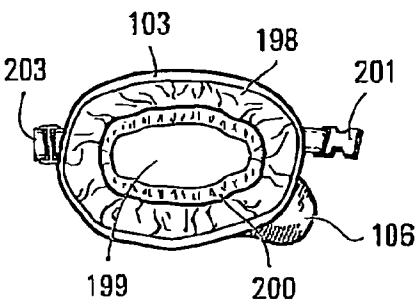
FIG. 16 shows a view of a hand protector according to an embodiment of the present invention from its hand-receiving end.
Figure 15:
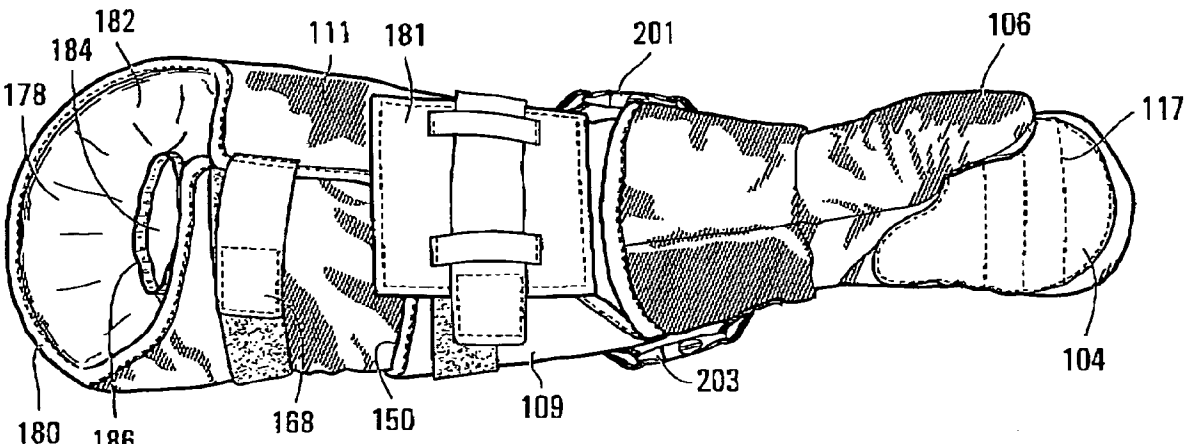
FIG. 15 shows a similar view of the protective sleeve shown in FIG. 14 with the protective mitt or glove positioned together.

Embodiments of the protective sleeve such as those described above, may comprise a sleeve adapted to cover and protect a person's arm and may either include or exclude a hand protector. Where a hand protector is provided, the hand protector may be permanently attached to the protective sleeve or may be releasable therefrom. An embodiment of a sleeve having a releasable hand protector is shown in FIGS. 14 to 16. The protective sleeve 101 is similar to that shown in FIGS. 7 to 13, and similar parts are designated by the same reference numerals. As shown in FIG. 14, the protective sleeve has upper and lower free ends 180, 196 in which the lower end terminates in the wrist or cuff region. The lower end 196 may optionally comprise a cuff section 197, and the cuff section may comprise a relatively soft material for comfort. The cuff section may be adapted to allow the opening formed thereby to be adjustable in size and may, for example, comprise a stretchable or elasticated material.

A separate hand protector 103 is in the form of a mitt (although it could be formed as a glove with separate finger pockets) and has a similar construction to the hand protector described above in connection with FIGS. 7 to 13. The hand protector 103 comprises a cuff region 105 for receiving and overlapping an end portion 196 of the protective sleeve to provide continuous protection in the transition between the sleeve and hand protector. Referring to FIGS. 14 and 16, a protective barrier or curtain 198 is provided adjacent the hand-receiving end of the hand protector to prevent objects passing into the hand protector between the cuff region 105 and a person's wrist or lower arm. The protective barrier 198 comprises an annular skirt whose outer circumferential edge is attached to and around the circumference of the cuff 105 and has an aperture or opening 199 for receiving a person's hand. The circumferential edge 200 of the aperture 199 may be adjustable to allow the length of the circumference to be varied. In one embodiment, the edge of the aperture may be stretchable or elasticated and sized to fit closely and tightly about a person's wrist or arm to assist in reducing the possibility of objects passing between a person's arm and the aperture 199 into the interior of the hand protector, and possibly to secure the glove more tightly to a person's arm to reduce relative movement therebetween.

One or more fasteners 201, 203 may be provided to fasten the hand protector to the protective sleeve. One part of the fastener may be attached to the hand protector and another part to the sleeve, as for example shown in FIGS. 14 to 16. Each fastener may comprise any suitable fastener such as a snap fastener, a contact surface fastener, such as VELCRO™, or any other fastener.

Figure 17A:
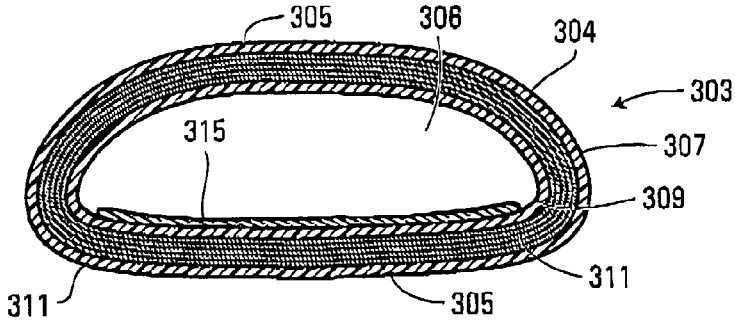
FIG. 17A shows a transverse cross-section through a hand protector according to an embodiment of the present invention.
Figure 17B:
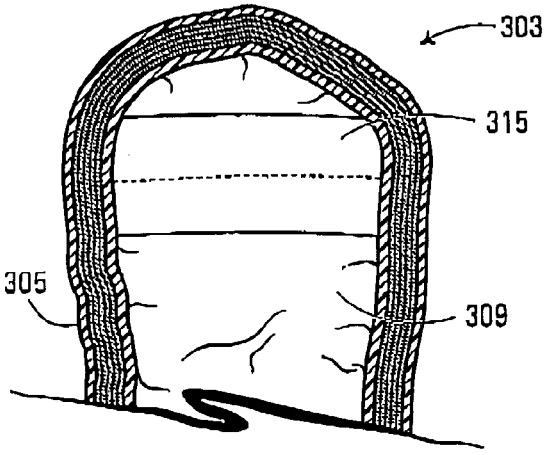
FIG. 17B shows a plan view of the lower part of the hand protector shown in FIG. 17A
Figure 17C:
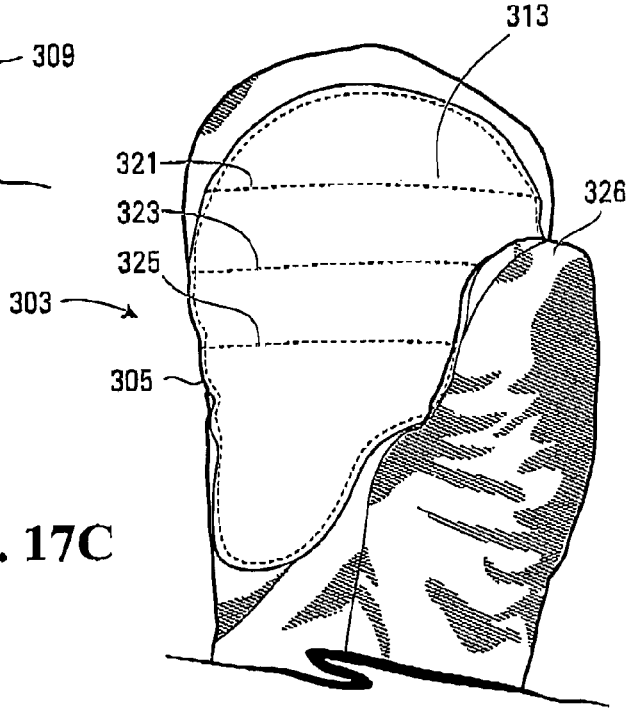
FIG. 17C shows a plan view of the lower part of the hand protector shown in FIGS. 17A and 17B.

FIG. 17A to 17C show an example of a hand protector according to an embodiment of the present invention. FIG. 17A shows a transverse cross-section through the pocket of a mitt (shown in FIG. 17C). The mitt comprises an upper part 304 and a lower part 305 defining a pocket 306 therebetween. The lower and/or upper parts comprise an inner cover layer 309 and an outer cover layer 311 (for example of NYLON™ or other material) and a plurality of layers, (for example between 2 and 15) of high tensile strength material or fabric, for example an arimid based fabric or other high tensile strength synthetic material.

A layer of high friction material 315 is positioned inside the pocket 306 on the lower part and advantageously provides a griping service to resist relative movement between the inside surface of the lower part 305 and a persons fingers, when the fingers are bent. The high friction surface maybe tacky and/or sticky. As shown in FIG. 17B, the high friction surface is confined to a discrete region, and in this embodiment is positioned is to contact a persons fingers.

As shown in FIGS. 17B and 17C, the various layers of the lower part are joined together by one or more transverse rows of stitching 321, 323, 325, to assist in increasing the flexibility of the lower part of the hand protector and to reduce the resistance to clenching the hand or fist. In embodiments of the hand protector, the outer surface of the lower part may also comprise a high friction surface and maybe tacky and/or sticky. In any embodiment, the high friction surfaces may be provided by C-TACK® or some other material.

In any embodiment, the sleeve may be provided with a fastener or feature to enable the sleeve to be attached or secured to another garment, such as a vest (e.g. protective vest) or other torso garment. For example, as shown in FIGS. 7 to 13, a fastener pad 207, comprising a surface contact fastener such as a hook or loop type may be provided on the sleeve, and may be conveniently positioned on the upper arm section, for example near the upper free end 180. Alternatively, the fastener pad may be used to attach a label or insignia associated with and/or identifying the person wearing the protective sleeve.

In any embodiment of the protective sleeve, the various sections of the sleeve may each be formed separately and connected together by any suitable means, for example sewing, stitching, gluing or any other suitable technique. Where portions of the sleeve comprise a plurality of layers of material, the layers of material may also be connected by any suitable means, including stitching, gluing or any other suitable technique, and the particular technique applied may be such that the flexibility of the various sections of the sleeve is preserved to at least some extent.

The protective sleeve/cover may be used by police, military personnel, fire fighters, and any other emergency, rescue, security personnel, as well as others.

In embodiments of this invention, any one or more features disclosed herein may be combined with any other feature disclosed herein or its equivalent.

Modifications to the embodiments described above will be apparent to those skilled in the art.

The invention claimed is:

1. A protective sleeve comprising:

a cut-resistant protective forearm section for covering at least a portion of a forearm, a cut-resistant, protective upper arm section for covering at least a portion of an upper arm and terminating with a free upper edge, a flexible connection between said forearm section and said upper arm section and connecting said forearm section to said upper arm section, and a cut-resistant protective elbow section having an outer elbow portion for covering an outer elbow region, said elbow section extending continuously from said outer elbow region to an inner elbow region to substantially surround the circumference of the elbow, wherein each of the forearm section, the upper arm section and the elbow section comprises one or more layers of flexible, cut-resistant, high-tensile strength fabric material, wherein said elbow section is coupled to said forearm section and said upper arm section to enable movement of said forearm section and said upper arm section relative to said outer portion of said elbow section in a longitudinal direction along the length of said upper and lower arm sections, and wherein the forearm section and the upper arm section both include outer arm portions for covering an outer arm region, and wherein the outer portion of the elbow section is movable relative to the outer portions of the forearm and upper arm sections.

2. A protective sleeve as claimed in claim 1, wherein said elbow section covers at least a portion of said flexible connection.

3. A protective sleeve as claimed in claim 1, wherein said elbow section overlaps a portion of one or both of said forearm section and said upper arm section.

4. A protective sleeve as claimed in claim 3, wherein the outer portion of said elbow section for covering said outer elbow region is free to slide in said longitudinal direction relative to one or both of said forearm section and said upper arm section.

5. A protective sleeve as claimed in claim 4, wherein the outer portion of said elbow section is detached from one or both of said forearm section and said upper arm section or only loosely attached thereto to allow relative movement therebetween.

6. A protective sleeve as claimed in claim 1, wherein said elbow section has an inner elbow portion for covering at least part of the inside of the elbow and wherein the elbow section has opposed edges which taper inwardly from said outer elbow portion to said inner portion.

7. A protective sleeve comprising:

a cut-resistant protective forearm section for covering at least a portion of a forearm, a cut-resistant, protective upper arm section for covering at least a portion of an upper arm and terminating with a free upper edge.

a flexible connection between said forearm section and said upper arm section and connecting said forearm section to said upper arm section, and a cut-resistant protective elbow section having an outer elbow portion for covering an outer elbow region, said elbow section extending from said outer elbow region to an inner elbow region to substantially surround the circumference of the elbow, wherein each of the forearm section, the upper arm section and the elbow section comprises one or more layers of flexible, cut-resistant, high-tensile strength material, and wherein said elbow section is coupled to said forearm section and said upper arm section to enable movement of said forearm section and said upper arm section relative to said outer portion of said elbow section in a longitudinal direction along the length of said upper and lower arm sections, wherein at least one of said forearm section, said elbow section and said upper arm section has opposed, separable longitudinal edges for defining a longitudinal opening therebetween.

8. A protective sleeve as claimed in claim 7, wherein the flexible, cut-resistant, high-tensile strength material of at least one of said forearm section, said elbow section and said upper arm section is sized to substantially fully surround a user's arm to enable the respective opposed, separable longitudinal edges to substantially close or overlap one another.

9. A protective sleeve as claimed in claim 8, further comprising retaining means for retaining the or each longitudinal opening in a closed position.

10. A protective sleeve comprising:

a cut-resistant protective forearm section for covering at least a portion of a forearm, a cut-resistant, protective upper arm section for covering at least a portion of an upper arm and terminating with a free upper edge, a flexible connection between said forearm section and said upper arm section and connecting said forearm section to said upper arm section, and a cut-resistant protective elbow section having an outer elbow portion for covering an outer elbow region, said elbow section extending from said outer elbow region to an inner elbow region to substantially surround the circumference of the elbow, wherein each of the forearm section, the upper arm section and the elbow section comprises one or more layers of flexible, cut-resistant, high-tensile strength material, and wherein said elbow section is coupled to said forearm section and said upper arm section to enable movement of said forearm section and said upper arm section relative to said outer portion of said elbow section in a longitudinal direction along the length of said upper and lower arm sections, the protective sleeve further comprising a skirt positioned adjacent the upper end of the sleeve and attached around the circumference of the upper arm section, and defining an aperture for receiving a person's arm, wherein said aperture has a circumferential edge, and the length of the circumferential edge is adjustable.

11. A protective sleeve comprising:

a cut-resistant protective forearm section for covering at least a portion of a forearm, a cut-resistant, protective upper arm section for covering at least a portion of an upper arm and terminating with a free upper edge, a flexible connection between said forearm section and said upper arm section and connecting said forearm section to said upper arm section, and a cut-resistant protective elbow section having an outer elbow portion for covering an outer elbow region, said elbow section extending from said outer elbow region to an inner elbow region to substantially surround the circumference of the elbow, wherein each of the forearm section, the upper arm section and the elbow section comprises one or more layers of flexible, cut-resistant, high-tensile strength material, and wherein said elbow section is coupled to said forearm section and said upper arm section to enable movement of said forearm section and said upper arm section relative to said outer portion of said elbow section in a longitudinal direction along the length of said upper and lower arm sections, the protective sleeve further comprising a hand protector for protecting a person's hand connected to said sleeve and/or releasably couplable to said sleeve, wherein the hand protector comprises an upper part for covering at least a portion of an upper part of a person's hand and a lower part for covering at least a portion of a lower part of a person's hand, said upper and lower parts defining a pocket therebetween for receiving a person's hand, and wherein at least one of the upper part and the lower part comprises one or more layers of flexible, cut-resistant, high-tensile strength material.

12. A protective sleeve as claimed in claim 11, wherein the hand protector has an inner lower surface for contacting the lower surface of a person's hand, wherein the surface is at least one of a high friction surface, a tacky surface and a sticky surface to substantially prevent slippage between a person's hand and the inner lower surface of the hand protector.

13. A protective sleeve comprising a cut-resistant protective forearm section for covering a forearm, a cut-resistant protective upper arm section for covering an upper arm and terminating with a free upper edge, said forearm section being flexibly coupled to said upper arm section to permit relative angular motion therebetween about an elbow joint, when in use, each of the forearm section and the upper arm section comprising one or more layers of flexible, cut-resistant, high-tensile strength material, one or both of said upper arm section and said forearm section having opposed, separable longitudinal edges extending along the length of the respective section for defining a longitudinal opening therebetween, said opposed longitudinal edges being oriented to extend along the inner side of a user's arm, and further comprising retaining means for retaining the longitudinal edges in a closed position, said retaining means including a fastener comprising first and second inter engageable and releasable fastening members which disengage and release by pulling one fastening member away from the other, the protective sleeve further comprising a cut-resistant protective elbow section for covering an elbow region and comprising an outer elbow portion for covering an outer elbow region and an inner elbow portion for covering an inner elbow region, the elbow section comprising one or more layers of flexible, cut-resistant, high-tensile strength material, the inner elbow portion having opposed, separable, longitudinal edges for defining a longitudinal opening therebetween, said elbow section further comprising a fastener comprising inter-engageable and releasable fastening members on opposed sides of the longitudinal edges of said elbow section which disengage and release by pulling one fastener member away from the other.

14. A protective sleeve as claimed in claim 13, wherein the fastener comprises an interactive surface fastener or a snap fastener.

15. A protective sleeve as claimed in claim 13, further comprising a web of flexible material connected between and extending around the circumference of said upper arm section and said lower arm section and having opposed, separable longitudinal edges to provide an opening at the inner elbow region.

16. A protective sleeve as claimed in claim 13, further comprising a skirt adjacent the upper end of the upper arm section and connected to and extending around the circumference of the upper arm section and defining an aperture therein which is sized to fit closely about a person's upper arm.

* * * * *